US005427356A

United States Patent [19]

Krotov et al.

[11] Patent Number: 5,427,356

[45] Date of Patent: Jun. 27, 1995

[54] LIFT AND PORTABLE LIFT

[76] Inventors: Adam Krotov; Sandra L. Krotov, both of 1130 SE. 20th St., Cape Coral, Fla. 33990

[21] Appl. No.: 227,243

[22] Filed: Apr. 13, 1994

[51] Int. Cl.[6] ..... B66D 3/02

[52] U.S. Cl. ..... 254/324; 182/129; 254/325; 254/334

[58] Field of Search ..... 254/213, 225, 226, 227, 254/323, 324, 325, 326, 327, 334, 335, 336, 337, 338; 182/101, 129; 212/218

[56] References Cited

U.S. PATENT DOCUMENTS

| | | | |
|---|---|---|---|
| 2,436,337 | 2/1948 | Smith et al. | 212/218 X |
| 3,446,309 | 5/1969 | Davis et al. | 182/129 |
| 3,902,700 | 9/1975 | Cox | 254/393 X |
| 4,128,228 | 12/1978 | Ziegelmann | 254/334 |
| 4,598,795 | 7/1986 | Larson | 182/129 |
| 4,770,273 | 9/1988 | McMakin et al. | 182/129 |
| 5,139,108 | 8/1992 | Pate | 182/129 |

FOREIGN PATENT DOCUMENTS

| | | | |
|---|---|---|---|
| 4031788 | 4/1992 | Germany | 254/324 |

*Primary Examiner*—Joseph J. Hail, III
*Attorney, Agent, or Firm*—Frank A. Lukasik

[57] ABSTRACT

The instant invention uses a ladder which attaches to a wheel-base type stabilizer which aids in rolling the object onto and off a roof or other elevated area. The ladder attaches to the wheel base stabilizer with two "U" shaped channels which receive two of the ladder rungs and the rungs are locked in place with two slip pins on the underside. At the top of the ladder is a leg which also has two "U" shaped channels which slip over the rungs of the ladder and are locked in place with two slip pins. A boom, with a mating square tube welded to it, receives the leg which is attached to the top of the ladder. A leg and wheel assembly are assembled into a second mating square tube welded to the other end of the boom and held in place with a slip pin.

3 Claims, 5 Drawing Sheets

LIFT AND PORTABLE LIFT

BACKGROUND OF THE INVENTION

1. Field of the Invention

This invention relates to an improved ladder attachment apparatus which facilitates the lifting of objects and machinery from the ground and other surfaces to the roof of a building or other elevated position, and more specifically relates to a stabilized, mobile, winch system and assembly which can be used in combination and conjunction with a number of commercially available ladders to provide a stronger, more stabilized ability to position a ladder for more convenient lifting of objects ranging in weight from refrigerant compressors up to considerably heavier objects for the purpose of transporting them to the roof of a building or other surface.

2. Background Information

Various types of ladder hoists, ladder hoist attachments, and ladder and ladder attachments facilitating the lifting of an operator or an object have been known or marketed for use by painting, maintenance and construction personnel. Following are typical inventions which were located during the process of a patent search.

U.S. Pat. No. 3,902,700 to Cox which discloses a portable bridge-crane structure designed to provide means of lifting construction materials and equipment such as compressors for air conditioners to the roof of a building where construction or installation is to be performed.

U.S. Pat. No. 4,128,228 to Ziegelmann discloses an extension ladder hoist having a hoist for raising and lowering articles from one elevation to another in which one portion of the support is a ladder.

U.S. Pat. No. 4,598,795 to Larson discloses a ladder hoist attachment consisting of a boom and prop combination that allows a conventional ladder to be used to hoist heavy loads.

U.S. Pat. No. 4,770,273 to McMakin et al discloses a ladder lift apparatus usable to lift heavy loads from the ground to a roof surface including a horizontally positioned, shoulder mounted lifting bar or beam with a winch means, fastened to the bar or beam where one end of the lifting bar or beam is pivotally connected to a vertically positioned ladder or extension ladder, with means to allow pivotal rotation of the upper end of the ladder toward the roof to deposit the load on the roof or into a window of a multi-story building.

U.S. Pat. No. 5,139,108 to Pate discloses a stabilized ladder power winch assembly which includes a winch mounting subassembly with two channeled portions, a reversible mount bracket subassembly with a cantilevered portion, a tiltable prop subassembly having a safety rung support extension, a frame and corresponding and aligned handle and leg portions, and a stabilizer subassembly with lateral support portions.

None of the prior art devices available are light weight for easy handling, nor simple to carry in a truck without occupying any extra space, nor are they quick to assemble and disassemble, nor easy to use and having the capability of more than one special purpose and yet packaged all in one unit and capable of lifting objects of both a lighter and heavier weight with little or no strain, therefore minimizing personal injury and maximizing safety.

One such unit that uses a shoulder apparatus to hold the boom in place while lifting the object. This can cause an unbalance in the system while trying to turn the winch by hand and at the same time trying to balance the weight as it is being lifted. As the object gets closer to the top of the ladder, the system becomes top heavy. Because of the lack of base stabilizing, this becomes a dangerous situation if the mechanic shifts a slight amount of weight to one side of the body, causing a side tipping action to begin and very difficult to control once it is started. Once the object has reached the top and is ready to be set on the roof, the serviceman must carefully walk backwards pivoting the base of the ladder as it approaches the building and then setting the object on the roof.

This same system uses a tri-pod set up for heavier objects. This improves the lift to the top of the ladder but the difficulty still exists when the object is ready to be set onto the roof. Someone now has to lift the tri-pod which now has more weight due to the larger object causing more top heaviness and having to be more careful not to start the tipping action from side to side while bringing the ladder towards the building to set the object down. Again setting up for a dangerous situation.

There are still other units that use a boom as a handle and a lifting mechanism with a motorized winch which attaches to the ladder but again this limits the unit to light lifting and also the inconvenience of locating power to the electric hoist. If this same hoist were converted to manual hoisting, it would create difficulty in holding and lifting at the same time.

There are still other units that use U-shaped wrap around ladder brackets with feet that lean against the wall of the building and then manually lifting the object to the roof from the ground. This unit again limits the weight and the size of the object to be lifted, because of the wrap around bracket which limits the size of the object by the size of the bracket. The swivel system, which it uses to set the object on the roof is interfered with by the roof bracket which the unit uses to stabilize the ladder. This would have to be removed before lowering the object onto the roof or the object and the swivel could not spin around.

The instant invention overcomes the above safety and weight limits because of its unique design. Due to its versatility, it allows for more than just roof-type work.

SUMMARY OF THE INVENTION

The instant invention uses a ladder which attaches to a designed wheel-base type stabilizer which helps to stabilize the ladder and aids in rolling the object onto and off a roof or other elevated area. The ladder attaches to the wheel base stabilizer with two "U"-shaped channels which receive two of the ladder rungs and the rungs are locked in place with two slip pins on the underside. At the top of the ladder is a leg which also has two "U"-shaped channels. These slip over the rungs of the ladder and are also locked in place with two slip pins on the underside.

There is a boom with a mating square tube welded to it to receive the leg which is attached to the top of the ladder. The welded square tubes have holes drilled into them to receive a slip pin to lock the legs in place and also for quick assembly and dis-assembly of the unit.

DETAILED DESCRIPTION OF THE PREFERRED EMBODIMENT

Figure 1:
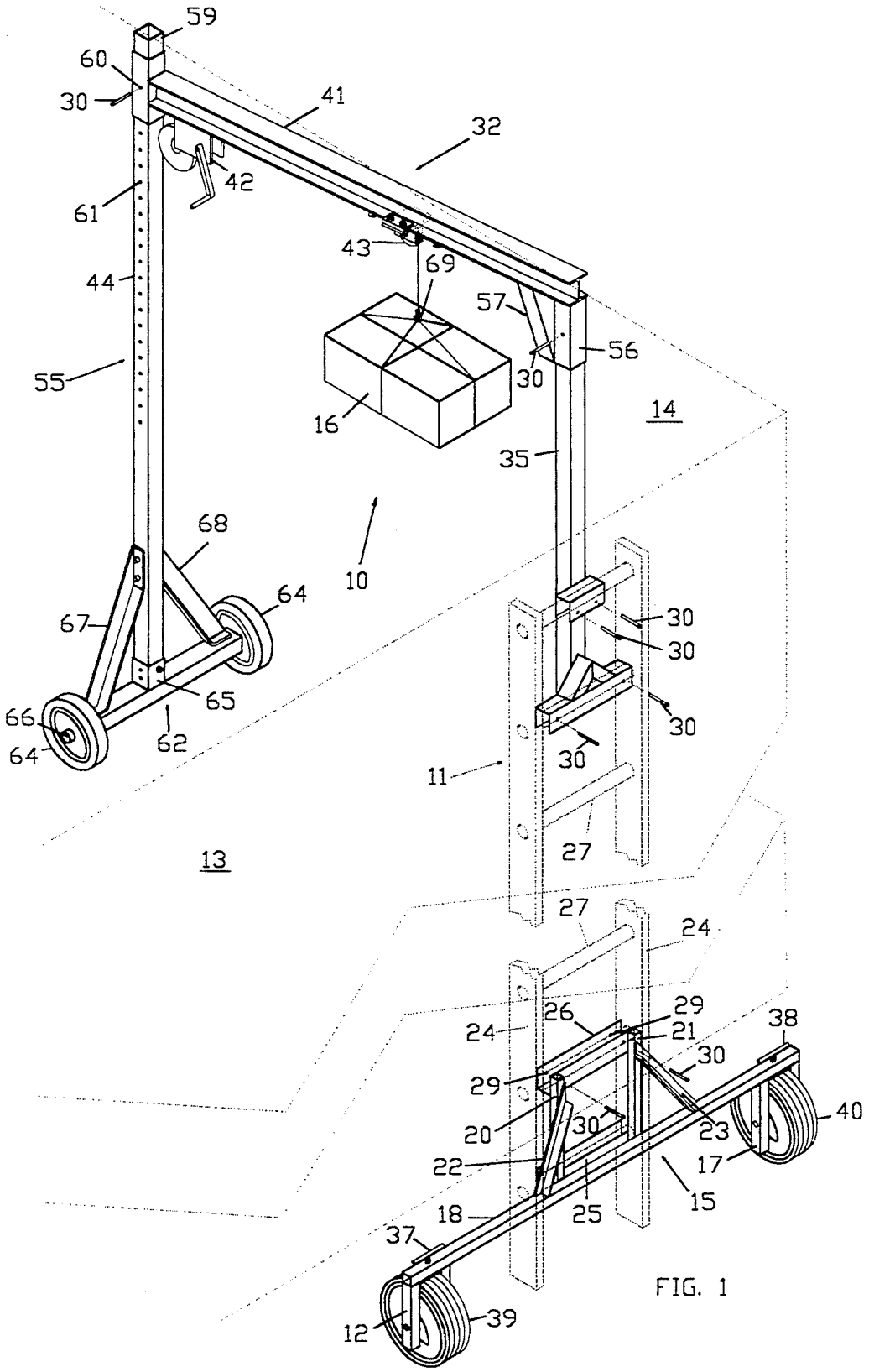
FIG. 1 is a perspective view of the lift and portable lift of the subject invention.

Referring now to the drawing, and more particularly to FIG. 1, there is shown a lift and wheel portable lift assembly 10, which is constructed in accordance with the present invention, and which, as shown, is adapted to be used in attached combination with conventional ladders 11, which are characteristically provided as two-piece extension ladders with two telescoped runged segments with the upper section being slid across the lower segment various ways to position the ladder for greater elevation against the side of a building shown generally at 13, extending to an elevated building roof surface 14. Portable lift assembly 10 uses a ladder 11 which is attached to wheel base-type stabilizer 15 which helps to stabilize the ladder 11 and aids in rolling the object 16, to be lifted, onto and off a roof.

Wheel mounts 12 and 17 are affixed to cross bar 18 which is sufficiently long enough to provide a wide base. Mounting frame assembly 19 comprises two vertical rods 20 and 21, fastened to the side of cross bar 18, in a position to fit between the runners 24 of ladder 11. Vertical rods 20 and 21 are reinforced with angular braces 22 and 23 which are affixed to cross bar 18. Two "U" shaped channels 25 and 26 are affixed horizontally in spaced relationship across vertical rods 20 and 21. The inside dimensions of "U" shaped channels 25 and 26 are dimensioned to engage the bottom two rungs 27 and 28 when assembled on ladder 11. Holes 29 are drilled through "U" shaped channel 26 to accommodate slip pins 30 which are used to lock the wheel base-type stabilizer 15 to ladder 11. Wheel brake assemblies 37 and 38 are provided to lock the wheels 39 and 40 in position when the lift and wheel portable lift assembly 10 is in a desired position.

Figure 2:
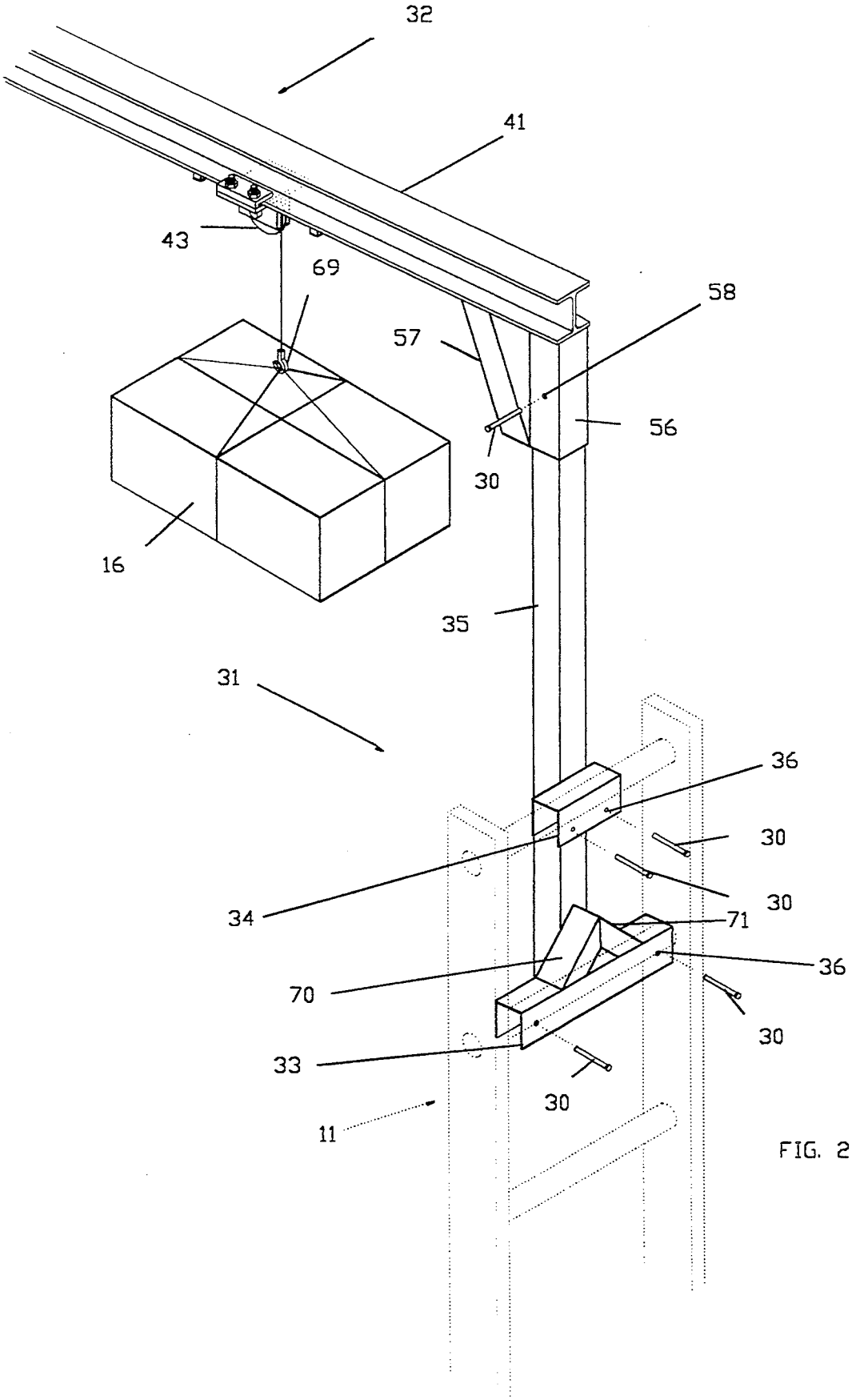
FIG. 2 is a perspective view of the ladder top mounting assembly and a sectional view of the top ladder mounting assembly and the lifting boom of the invention.
Figure 3:
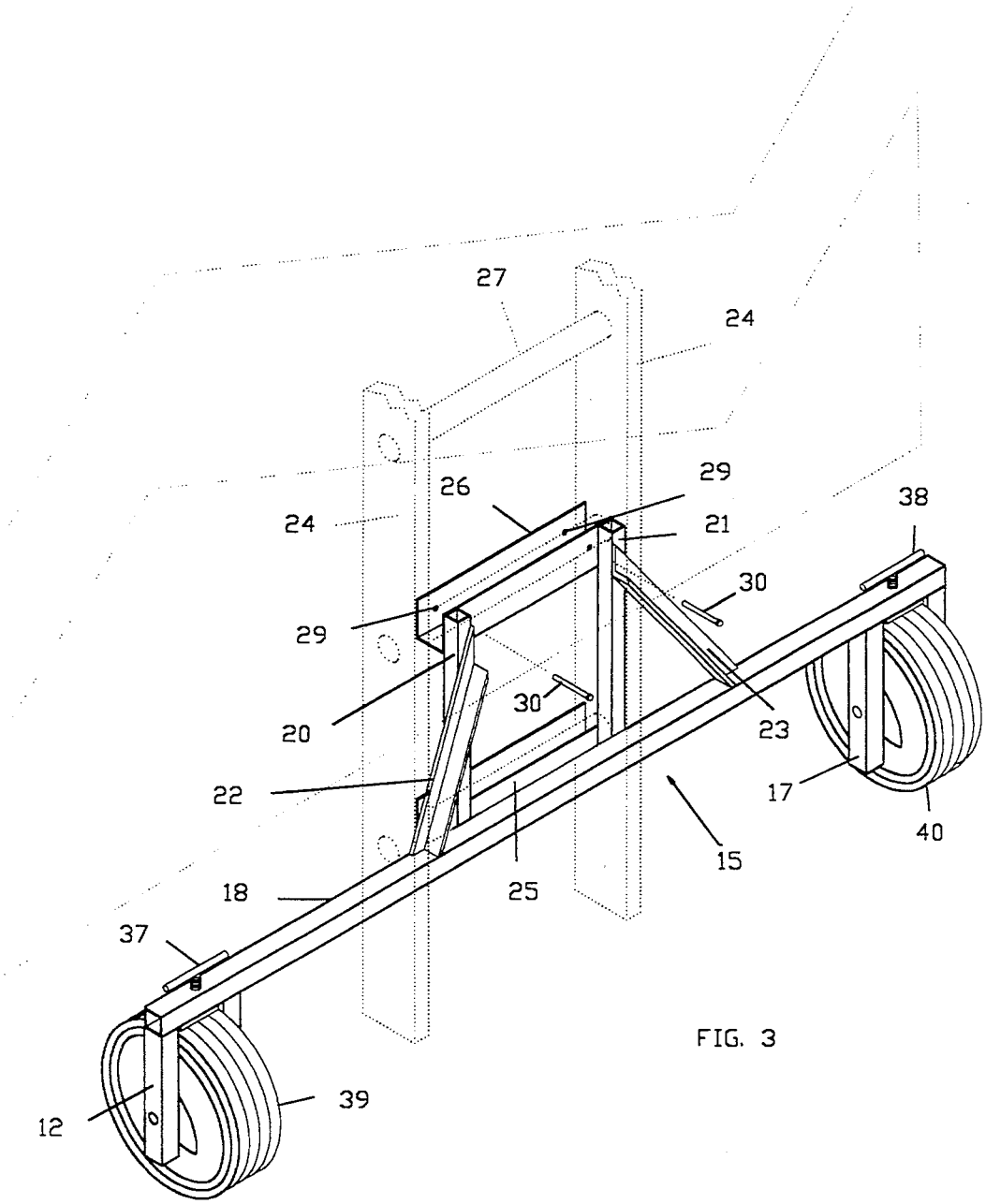
FIG. 3 is a perspective view of a wheel base stabilizer of the invention.

FIG. 2 is a perspective view of the ladder top mounting assembly 31 and lifting boom 32, partly in section as assembled on the top of ladder 11. Two "U" shaped channels 33 and 34, with angle braces 70 and 71, are fastened horizontally, in spaced relationship across vertical leg 35. The inside dimensions of "U" shaped channels 33 and 34 are dimensioned to engage the top two rungs of ladder 11. Holes 36 are drilled through "U" shaped channels 33 and 34 to accommodate slip pins 30 which are used to lock the top mounting assembly 31 to ladder 31.

Figure 4:
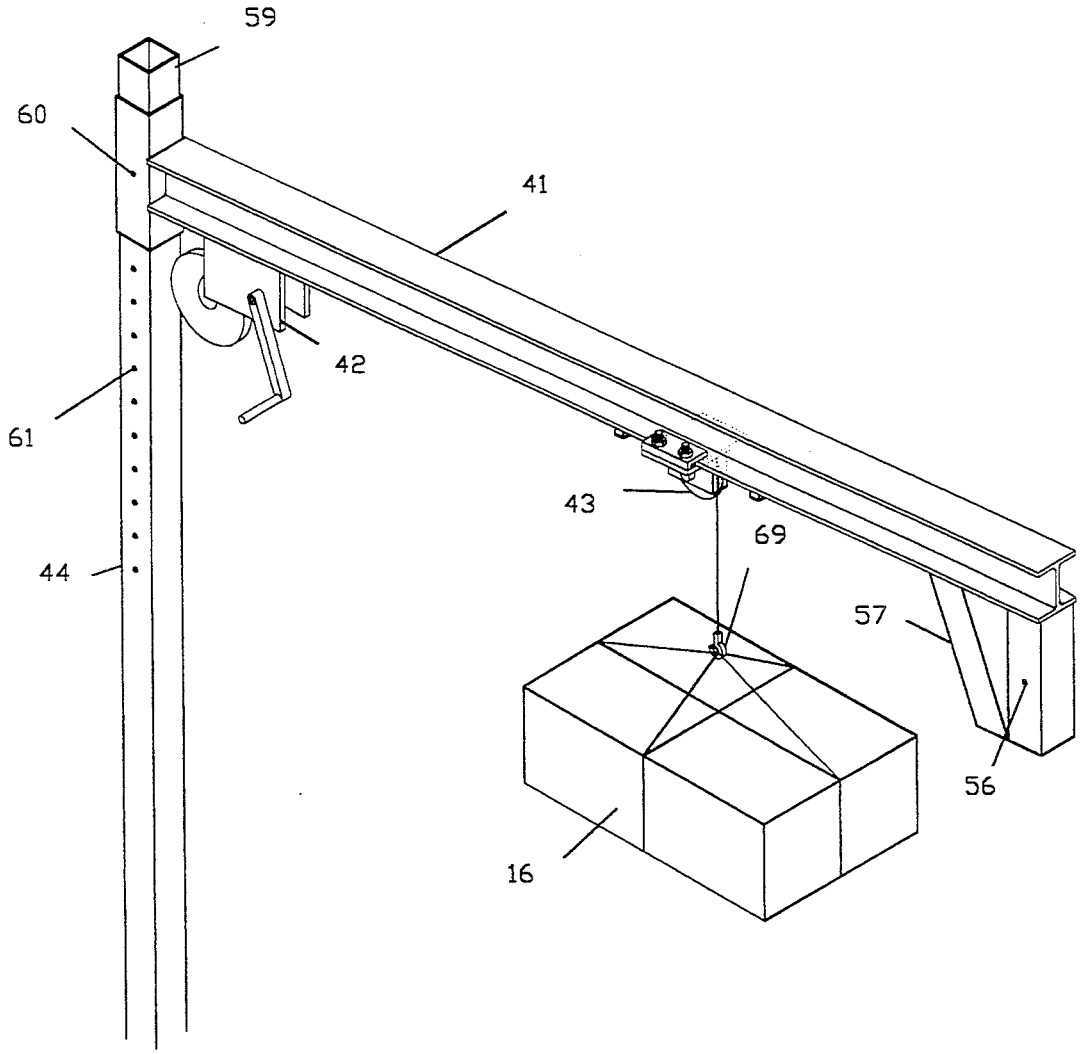
FIG. 4 is a perspective view of the boom and winch of the instant invention.
Figure 5:
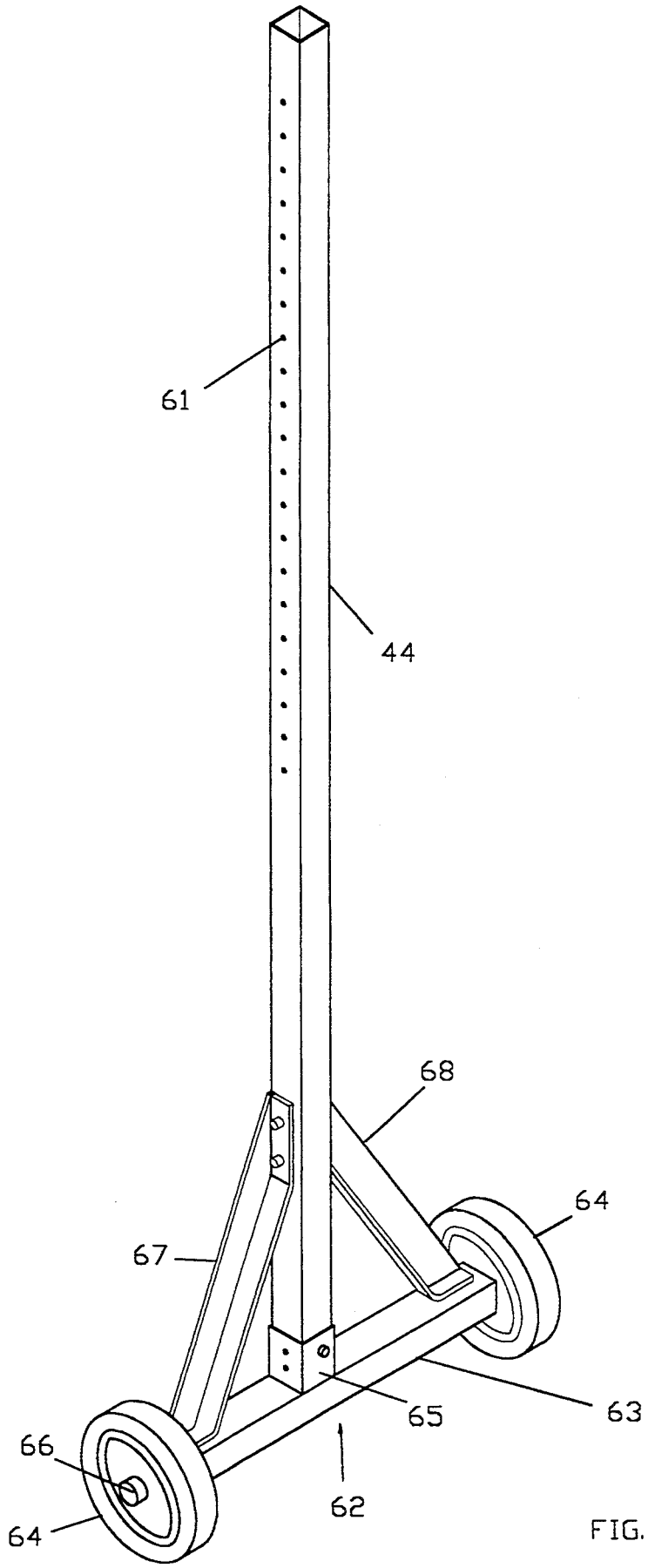
FIG. 5 is a perspective view of the top roof leg and wheels.

FIG. 4 is a perspective view of the boom 41, winch 42 and pulley 43. Also shown, in section, is leg 44 of the top roof leg and wheels assembly 55. Boom 41 is fitted with a mating square tube 56 by welding, and dimensioned to receive the end of vertical leg 35. Vertical leg 35 is reinforced with angular brace 57 which is welded to tube 56 and boom 41. Boom 41 is fabricated from a length of aluminum "I" beam. Hole 58 is drilled to mate with holes drilled in vertical leg 35 and fastened together with a slip pin 30 to lock them in place and also for quick assembly and disassembly of the unit. The end of boom 41, opposite tube 56, also has a welded square tube 59 welded thereto and dimensioned to receive the end of vertical leg 44 which is locked in place by a slip pin 30 inserted in holes 60. Adjustment holes 61 are provided in vertical leg 44 to adjust the height of the lifting boom 32 above the roof surface 14.

The top roof leg and wheels assembly 55, is fastened to lifting boom 32 with square tube 59 and slip pin 30. Fastened to the lower end of vertical leg 44 is a wheel assembly 62 comprising a cross bar 63, wheels 64 mounted for rotation on shafts 66, square tube 65 fastened at the center of cross bar 63, and angular braces 67 and 68 fastened between vertical leg 44 and cross bar 63 to provide stability for the assembly 55.

The invention is a light weight unit because of its aluminum construction. The "I"beam boom 41 design allows the unit, when disassembled, to easily fit together into a small compact shape which, when using the same "U" shaped channel brackets of the vertical leg 35, can easily be mounted onto the roof of the truck to the extension ladder rungs 27, and 28, thereby not occupying any extra space within the truck.

The use of the lift and wheel portable lift assembly 10 is very simple. The lifting boom 32 is attached to the ladder top mounting assembly 31 and the assembly 31 is assembled on ladder 11 and locked in place with the slip pins 30. The top roof leg and wheels assembly 55 is attached to the other end of lifting boom 32. The wheel base-type stabilizer 15 is also attached to the lower end of ladder 11. The ladder 11 is then rolled away from the building to the proper lifting position, the wheels 39 and 40 are locked in place and the unit is ready to lift or lower objects.

Once in position, an operator simply hooks an object 16 with hook 69 and raises the object 16 by cranking the winch 42. When the object 16 is raised between the ladder 11 and the building 13, just above the roof surface 14, the braking mechanism braking assembly 37 and 38 is released and the object 16 is wheeled above the roof surface 14. The reverse of the above is used to lower the object 16 to the ground.

With the above arrangement, excluding the ladder 11, but using a wheel base-type stabilizer 15 instead of a ladder 11 (or just placing the unit directly onto the roof surface 14 with both legs approximately the same height), the operator may use the unit to raise and lower objects 16 onto flat roofs where a scuttle hole is the means of access to the equipment. Simply straddle the lift and wheel portable lift assembly 10 over the scuttle hole and lower the lifting hook 69 to raise or lower the object 16. Once the object 16 is raised, and the wheel base-type stabilizer 15 is used, the object 16 is wheeled onto the roof and then to its location. If the wheel portable lift assembly 10 is not used, but the object 16 was set directly onto the roof surface 14, and once the object 16 is above the scuttle hole, a platform is set above the scuttle hole, and the object 16 is lowered onto the platform and the object 16 is free to be handled in any manner.

As stated above, the invention has more than one use. The invention has a versatile feature, i.e., once the legs 35 and 44 are removed from both ends, apply the proper truss attachments to the trusses and then easily slip the boom 41 into the brackets which will support the boom 41, then lifting of objects into attics or high ceilings is made simple. For example, air handlers that once were needed to be taken apart to lift into an attic, or where two people were needed to dangerously lift the object into the attic is now made simple and safe to lift, when using this invention with the available brackets.

By attaching the special designed wheel base to the end opposite the winch, and a short extension ladder (up to six feet tall) at the winch end, with another wheel base, the unit may be set to lift compressors and condensing units from the tops of walk-in coolers. It may easily be moved around in somewhat confined space where other equipment would not be able to be used. There is a required height of twenty-one inches between the top of the cooler and the ceiling to be able to operate in this case. It would be a rare problem where the invention could not be used.

The invention was built with the significant feature of easy assembly and disassembly, by the use of slip ring pins which slide into the different legs and attachments. The invention is easy to transport from job to job, occupying the least amount of space in the truck by having the unit simply mount onto the ladder rung, locking into place with a slip pin, therefore, not occupying any space inside the truck.

The key assemblies of the invention are: the ladder wheel base stabilizer 15, the winch end support leg 44 and wheel assembly 62, the lifting boom 32, and the dual-channel ladder top mounting assembly 31. The invention makes it easy to lift heavy objects with maximum safety. The wide open space which was created and unobstructed when the ladder is rolled away from the building, allows for raising and lowering of large, awkward, objects with ease. Also, the quick assembly and disassembly of the invention improves productivity.

While the present invention has been described in connection with the particular embodiments thereof, it will be understood that many changes and modifications of this invention may be made by those skilled in the art without departing from the true spirit and scope thereof. For example, other types and kinds of materials may be used instead of aluminum for each of the subassemblies. Accordingly, the appended claims are intended to cover all such changes and modifications as fall within the true spirit and scope of the present invention. The reader is requested to determine the scope of the invention by the appended claims and their legal equivalents, and not by the examples which have been given.

What is claimed is:

1. A lift and portable lift apparatus for lifting a heavy load from the ground to the roof of a building comprising in combination:

a lifting boom having a first end and a second end and a winch and pulley mounted thereon between said first and second ends, an end support leg and wheel assembly removably attached to said lifting boom at said first end, a ladder top mounting assembly having a top end removably attached to said lifting boom at said second end, and having a plurality of channels at a bottom end, a vertically positioned, heavy duty ladder having multiple rungs, said ladder top mounting assembly plurality of channels removably engaged with ladder rungs at a top end of said ladder, and a ladder wheel base stabilizer having a pair of vertical rods affixed to a top surface and a pair of wheel mounts affixed to a bottom surface at a first end and a second end, said vertical rods having a pair of parallel, horizontally spaced channels removably engaged with ladder rungs at a bottom end of said ladder and said wheel mounts each having a wheel rotatably mounted therein and a wheel brake assembly mounted thereon.

2. The lift and portable lift apparatus as described in claim 1 wherein said top mounting assembly plurality of channels and said ladder wheel base stabilizer horizontally spaced channels consist of "U" shaped channels having holes drilled therein for receiving slip pins for locking said apparatus in place on said ladder rungs.

3. The lift and portable lift apparatus as described in claim 1 wherein said lifting boom comprises an "I" beam having a first square tube affixed at said first end and a first end of a second square tube affixed to a bottom surface of said "I" beam second end and having an angular brace connecting a second end of said second square tube to said "I" beam.

* * * * *